US005836487A

United States Patent [19]

Lam

[11] Patent Number: 5,836,487

[45] Date of Patent: Nov. 17, 1998

[54] GARMENT HANGER

[76] Inventor: Peter Ar-Fu Lam, 20104 Wayne Ave., Torrance, Calif. 90503

[21] Appl. No.: 703,903

[22] Filed: Aug. 27, 1996

Related U.S. Application Data

[63] Continuation-in-part of Ser. No. 247,318, May 23, 1994, abandoned.

[51] Int. Cl.[6] ..... A47G 25/40; A47G 25/14

[52] U.S. Cl. ..... 223/94; 223/89

[58] Field of Search ..... 223/85, 88, 89, 223/92, 94, 95; D6/315

[56] References Cited

U.S. PATENT DOCUMENTS

| | | | |
|---|---|---|---|
| 912,047 | 2/1909 | Thomas | 223/94 |
| 1,605,184 | 11/1926 | Heddens | 223/85 |
| 2,531,108 | 11/1950 | Casey | 223/89 |
| 4,673,114 | 6/1987 | Douglas | 223/89 |
| 5,054,666 | 10/1991 | Blanchard | 223/88 |
| 5,197,639 | 3/1993 | Jerman et al. | 223/88 |

FOREIGN PATENT DOCUMENTS

| | | | |
|---|---|---|---|
| 2120542 | 5/1983 | United Kingdom | 223/85 |
| 2270186 | 8/1992 | United Kingdom | 223/85 |

*Primary Examiner*—Bibhu Mohanty

[57] ABSTRACT

Adjustable garment hanger embodiments (20) are disclosed having arms (22, 24) which each include a proximal portion (32) joined to a hanger medial portion (26) and a distal portion (34) carried by the proximal portion. The arms have a garment supporting width (36) and their distal portions are configured for physical distortion to facilitate adjustment of that width.

34 Claims, 12 Drawing Sheets

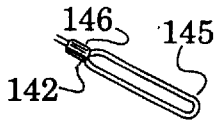
FIG. 6H
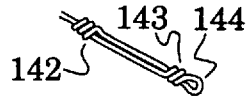
FIG. 6G
FIG. 6F
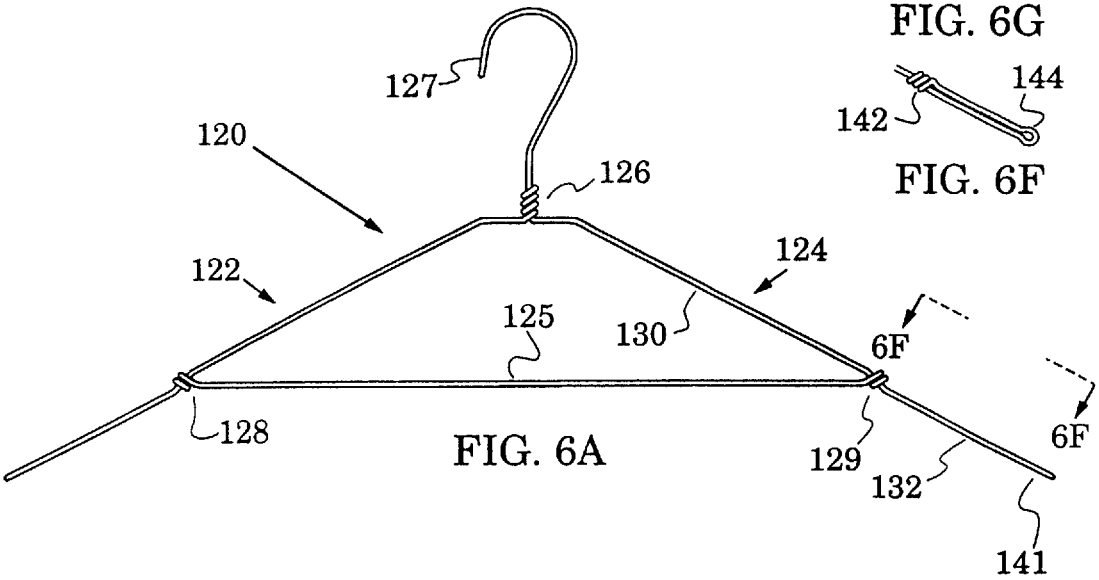
FIG. 6A
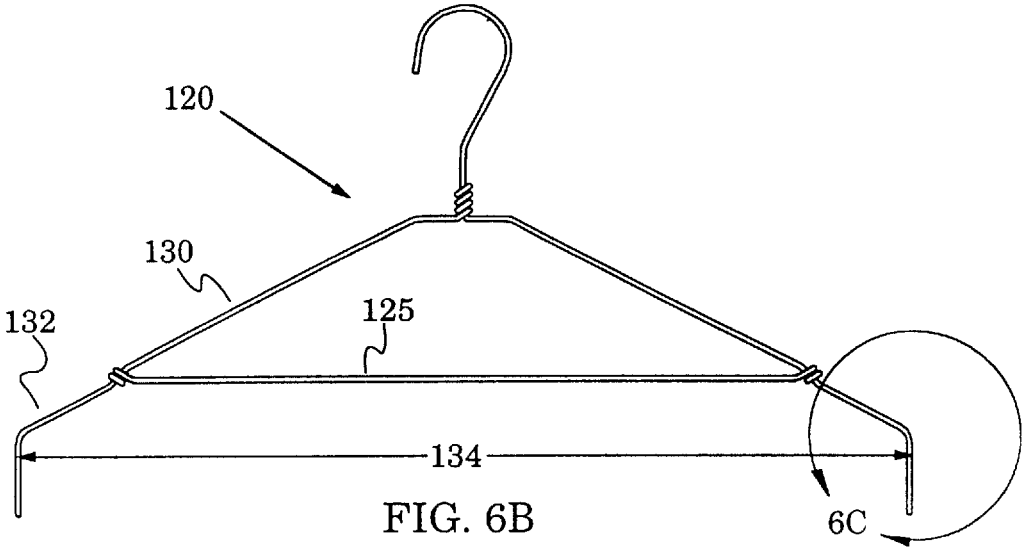
FIG. 6B
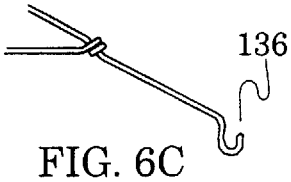
FIG. 6C
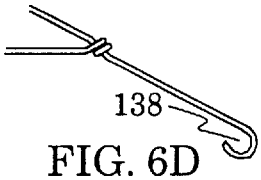
FIG. 6D
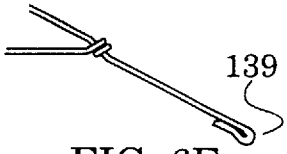
FIG. 6E

GARMENT HANGER

RELATED APPLICATIONS

This is a continuation-in-part of pending parent application U.S. patent application Ser. No. 08/247,318, now abandoned, filed 05/23/94 which are incorporated herein by reference.

FIELD OF THE INVENTION

The present invention relates generally to garment hangers.

BACKGROUND OF THE INVENTION

Many garments, e.g., shirts, coats, have a shoulder-to-shoulder span which is best supported by a garment hanger of commensurate width. To properly support a variety of sized garments, manufacturers, retailers and end users must stock a variety of fixed size garment hangers or use adjustable width hangers.

The prior art is replete with various configurations of garment hangers which incorporate structure for selectively adjusting the hanger's width to accommodate different size garments. U.S. Pat. No 2,360,119 to Gallagher; 3,874,572 to McClenning; 2,574,999 to Bell and applicant's U.S. Pat. Nos. 5,085,358 and 5,102,019 disclose distal portions traveling along the proximal arms of an adjustable hanger; U.S. Pat. No. 4,892,238 to Pinczykowski discloses a press hanger; German Patent 270954 to Potschke discloses a wire hanger; U.S. Pat. No. 1,336,429 to Gould; 2,461,686 to Hiebert and German Patent 81936 to Casiraghi disclose embodiments of folding hanger; French Patent 1,011,899 to Reveillac discloses an adjustable hanger with indicia; U.S. Pat. No. 5,022,570 to Watford discloses a hanger for sweaters and knit garment; German Patent 238,882 disclose a telescopic hanger; and U.K. Pat. No. 2,120,542 to Outhwaite discloses an automatically adjustable skirt hanger as do certain ones of the references cited therein.

SUMMARY OF THE INVENTION

The present invention is directed to garment hangers having distal arm portions extending from the support arms of traditional triangular cloth hanger. The lateral extension of the distal arm portions can be adjusted to conform the hanger's width with the shoulder span of a particular garment. In particular, hangers in accordance with the invention include first and second elongate arms arranged in an obtuse angle from each other extending in opposite lateral directions from a medial body portion to define a garment supporting width. The arms each have a proximal portion joined to the medial portion and a distal portion carried by the proximal portion and extending along its axis. Each of the distal portions is configured for physical distortion thereof to adjust its lateral extension from its respective proximal portion. This distortion facilitates adjustment of the garment supporting width. The span between the remote ends of said proximal portions defines proximately the minimum shoulder width of garment to be supported and the maximum span between the remote ends of said distal portions defines proximately the maximum shoulder width of garment to be supported. Each said proximal portion is stronger relative than the corresponding distal portion of the garment hanger. The strong proximal portion is to rigidly supporting the garment and the weaker distal portion is to facilitate the distortion of the distal portions to adjust the width therebetween.

In a preferred embodiment, the proximal portions are formed of a plastic material with the distal transverse cross sectional area reduced from the proximal transverse cross sectional area to facilitate mechanical trimming of the distal portion to reduce its lateral extension.

In another preferred embodiment each of the distal portions includes a plurality of selectively removable tabs which are defined by laterally spaced indentations to facilitate their removal.

In another preferred embodiment each of the distal portions includes a plurality of articulated and removable segments to facilitate reduction of the lateral extension.

In another preferred embodiment useful in extending the invention to regular wire hanger, each of the distal portions is formed of a ductile material with a cross sectional area sufficiently small to facilitate bending of said wire by a hanger user to reduce its lateral extension.

In another preferred embodiment each of the distal portions is formed as a resilient strap which is bent upon itself and received in a guide structure defined by the respective proximal portion.

The novel features of the invention enable the garment hanger to be adjusted by a fixture to provide custom hanger width adjustment efficiently The novel features of the invention are set forth with particularity in the appended claims. The invention will be best understood from the following description when read in conjunction with the accompanying drawings.

BRIEF DESCRIPTION OF DRAWINGS

FIG. 6A is an elevation view of another preferred adjustable width garment hanger embodiment;

FIG. 6B is a view similar to FIG. 6A showing another distal portion arrangement;

FIG. 6C is a view of the area 6C of FIG. 6B showing another distal portion arrangement;

FIG. 6D is a view similar to FIG. 6C showing another distal portion arrangement;

FIG. 6E is a view similar to FIG. 6C showing another distal portion arrangement;

FIG. 6F is a view along the plane 6F—6F of FIG. 6A showing another distal portion embodiment;

FIG. 6G is a view similar to FIG. 6F showing another distal portion embodiment;

FIG. 6H is a view similar to FIG. 6F showing another distal portion embodiment;

DESCRIPTION OF THE PREFERRED EMBODIMENTS

Figure 1A:
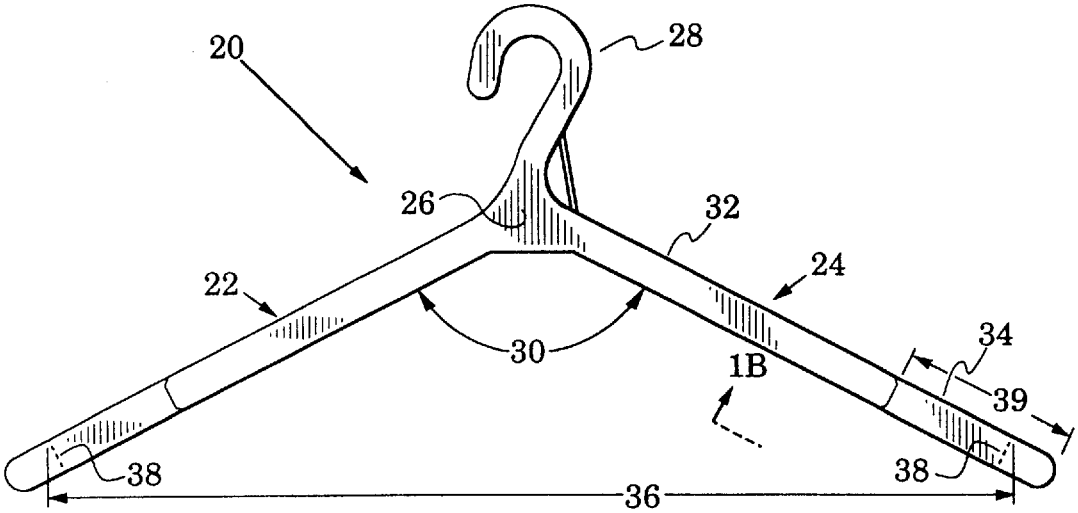
FIG. 1A is an elevation view of a preferred adjustable width garment hanger embodiment in accordance with the present invention.

Attention is first directed to FIG. I which is an elevation view of a preferred adjustable width garment hanger embodiment 20 in accordance with the present invention. The garment hanger 20 includes a pair of elongate support members in the form of arms 22, 24 which are joined at a hanger medial portion 26 with a suspension member in the form of a hook 28. The arms 22, 24 are arranged to extend laterally outward and downward from the medial portion 26, i.e., they define an obtuse angle 30 therebetween. Thus, the arms 22, 24 are in the shape of a traditional triangular hanger which form a support that conforms to the typical shoulder shape of many common garments, e.g., shirts, dresses, coats.

Figure 1B:
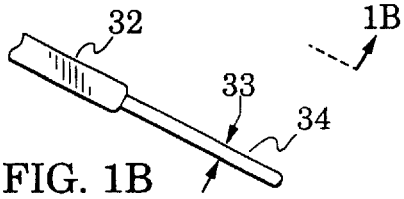
FIG. 1Bis a view along the plane 1B—1B of FIG. 1A.

Each of the arms 22, 24 include a proximal portion 32 and a distal portion 34. The proximal portion 32 defines a cross sectional area sufficient to support the weight of any common garment. The distal portion 34 is substantially coaxial with the proximal portion 32 but its cross sectional area is reduced relative thereto. In particular, as shown in FIG. 1B which is a view along the plane 1B—1B of FIG. 1A, the transverse thickness 33 of the distal portion 34 is considerably reduced from that of the proximal portion 32. This transverse reduction configures the distal portion 34 for trimming with any common household tool, e.g., scissors.

To conform the hanger 20 to a garment having a specified lateral shoulder-to-shoulder span, the distal ends 34 would be trimmed, e.g., along the trim lines 38 shown in broken line, to give the arms 22, 24 a corresponding garment supporting width 36. To facilitate trimming of the distal ends 34, the garment hanger 20 is preferably formed of a relatively soft plastic with a transverse dimension 33 of not more than 3 millimeters and with a lateral dimension 39 greater than 5 millimeters.

Figure 2A:
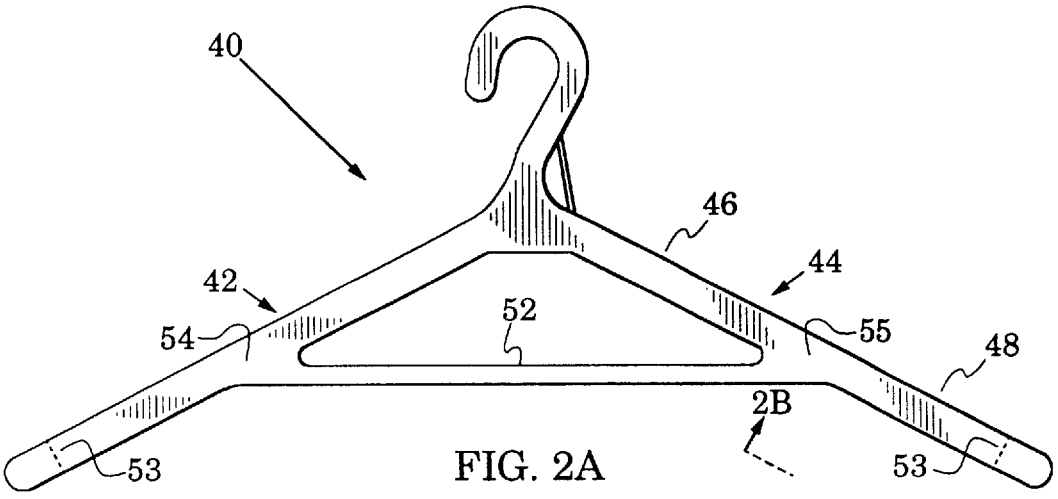
FIG. 2A is an elevation view of another preferred adjustable width garment hanger embodiment.

FIG. 2A illustrates another preferred garment hanger embodiment 40. The hanger 40 is similar to the hanger 20 but its arms 42, 44 each have proximal and distal portions 46, 48 of substantially equal transverse thickness. This transverse thickness 50 is substantially the same as that of the distal portion 34 of the hanger 20. To provide sufficient rigidity and strength for support of garments, a brace in the form of a horizontal rod 52 joins the arms 42, 44 at junctions 54, 55. Thus, the junctions 54, 55 form the boundary between the proximal portion 46 and the distal portion 48. The joined proximal portions 46 and rod 52 have sufficient load bearing strength while the distal portions 48 are configured for easy trimming along a trim line, e.g., the broken line 53. The rod 52 is also configured to support other garments, e.g., slacks, pants. Similar to the embodiment of FIG. 1A and 1B, the proximal portion of other embodiments are of stronger shoulder supporting characteristic than the respective distal portion.

Figures 3A, 3B, 3C, 3D:
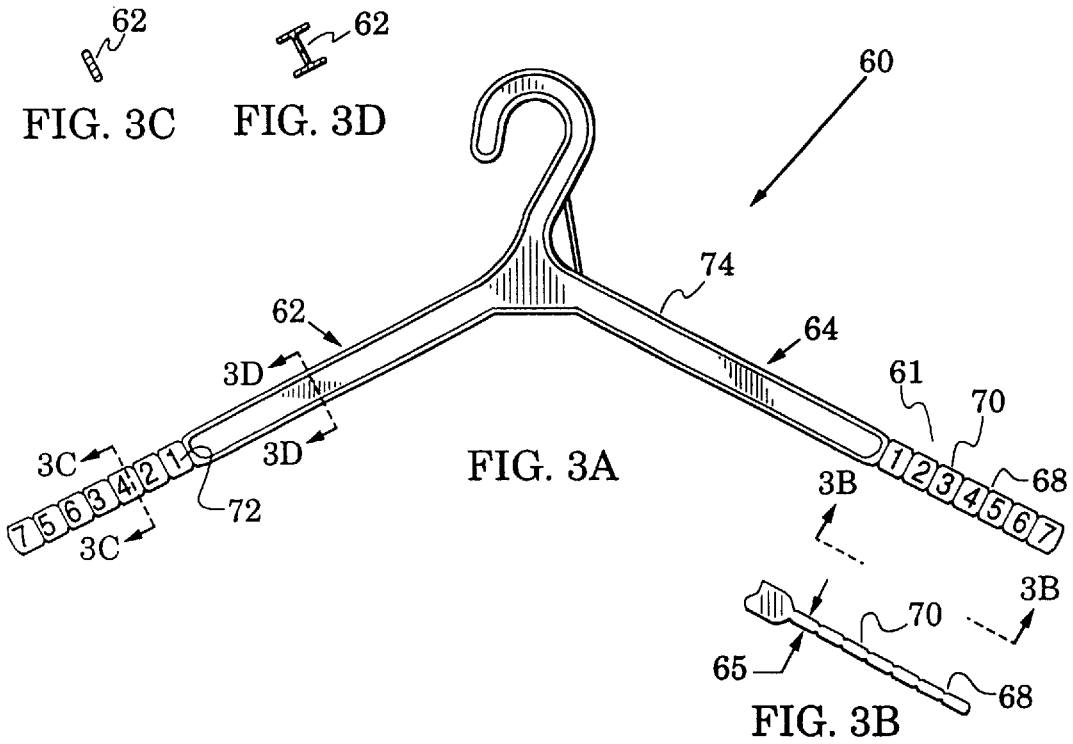
FIG. 3A is an elevation view of another preferred adjustable width garment hanger embodiment.
FIG. 3B is a view along the plane 3B—3B of FIG. 3A.
FIG. 3C is a view along the plane 3C—3C of FIG. 3A.
FIG. 3D is a view along the plane 3D—3D of FIG. 3A.

Another preferred garment hanger 60 is shown in the elevation view of FIG. 3A. The hanger 60 is similar to the hanger 20 of FIGS. 1. However, the distal portion 61 of each of the arms 62, 64 is not only configured with a reduced thickness 65 but also configured with spaced indentations in the form of grooves 68 along each transverse side. These grooves 68 divide each distal portion 61 into a plurality of tabs 70. In operation, the hanger 60 is trimmed for the shoulder-to-shoulder width of a specific garment by removing a sufficient number of tabs 70 from each distal portion 61. Preferably, the hanger 60 is formed of a plastic that will experience fatigue after a few repeated bending movements.

The grooves 68 encourage the distal portion 61 to break only between tabs 70 in response to this bending action. FIG. 3B is a view along the plane 3B—3B. This view illustrates that the tabs 70 bear indicia 72 which facilitates selection of the tabs to be removed. The indicia 72 are each related to the garment support width 36, i.e., a higher number indicates a greater width 86. As shown in FIG. 3C, a view along the plane 3C—3C, the cross sectional configuration of the distal portions 61 is similar to the distal portions 34 of the hanger 20. FIG. 3D is a view along the plane 3D—3D to show another preferred cross sectional configuration of proximal arm portions. The proximal portions 74 define an I beam configuration for strength and rigidity.

Figures 4A, 4B:
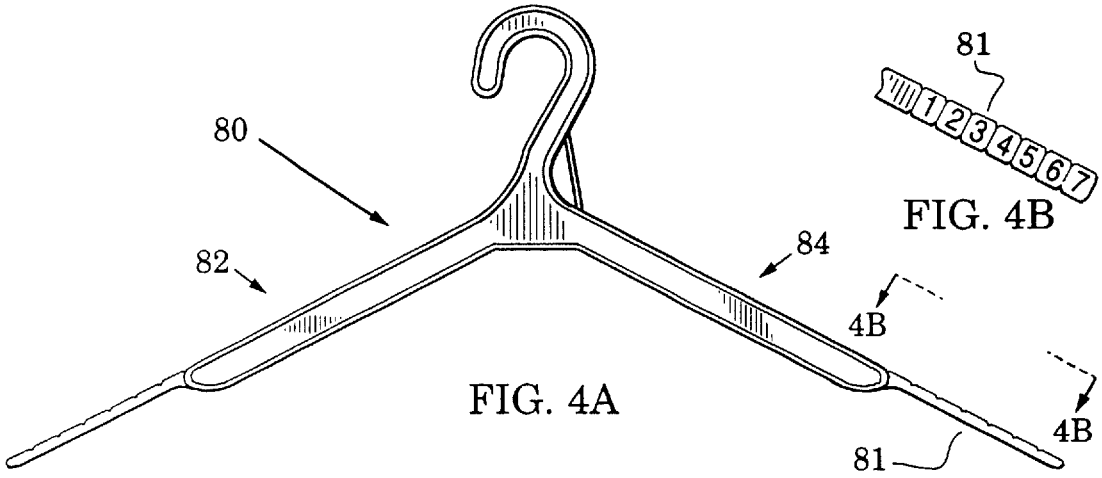
FIG. 4A is an elevation view of another preferred adjustable width garment hanger embodiment.
FIG. 4B is a view along the plane 4B—4B of FIG. 4A.

FIG. 4A illustrates another preferred hanger embodiment 80. The hanger 80 is similar to the hanger 60 of FIGS. 3 but the distal portions 81 of its arms 82, 84 are rotated substantially orthogonally relative to the distal portions 61 of the hanger 60. The arm shapes of hangers 60, 80 may therefore be selected to best conform with specific garment types.

Figure 5A:
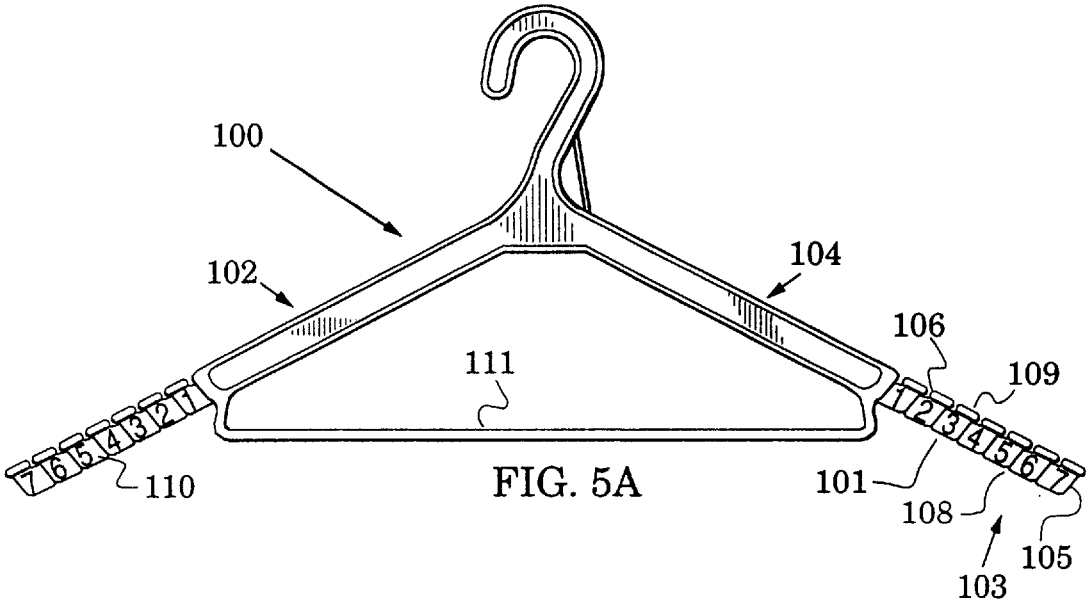
FIG. 5A is an elevation view of another preferred adjustable width garment hanger embodiment.

A preferred hanger embodiment 100 is illustrated in the elevation view of FIG. 5A. The hanger 100 is similar to both the hangers 60 and 80 of FIGS. 3, 4. In particular, the hanger 100 provides tabs 101 on each distal arm portion 103 of the arms 102, 104. The tabs 101 can be selectively removed to conform the hanger to a specific garment shoulder-to-shoulder width. However, each tab 101 includes orthogonally arranged lower and upper parts 105, 106. The lower parts 105 are delineated by grooves 108 therebetween. The upper parts 106 are disposed at the top of the lower parts 105 to define a garment supporting surface 109. In accordance with another feature of the embodiment 100, when selected tabs 101 are broken away the exposed groove of the outermost tab lies beneath and inward from that tab's upper part 106. Thus, the supported garment is protected from any rough edges that might remain on the outermost groove. The tabs 101 each bear indicia 110 to aid in selective removal. The embodiment 100 also includes a horizontal rod 111.

Figure 5B:
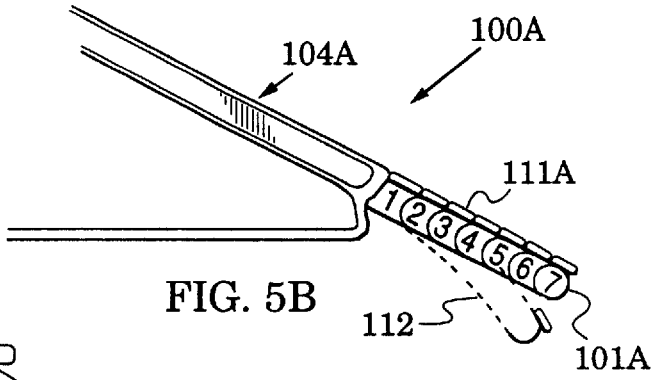
FIG. 5B is an elevation view of another preferred adjustable width garment hanger embodiment.
Figure 5C:
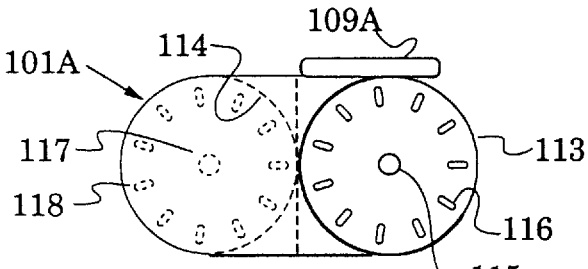
FIG. 5C is a side view of an articulated segment in the garment hanger of FIG. 5B.
Figure 5D:
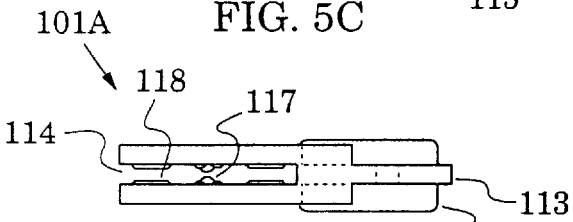
FIG. 5D is an bottom view of the segment of FIG. 5C.

In another preferred embodiment 100A, shown in FIG. 5B, the tabs 101 of embodiment 100 are altered to define articulated segments 101A. The segments 101A can be rotated relative to each other so as to be bent downward as indicated by the broken lines 112. The segments 101A are more clearly shown in the side and bottom views respectively of FIGS. 5C, 5D. Each segment defines at one end thereof, a disc 113 and, at an opposed end, a slot 114. The disc 113 has a centrally located hole 115 and a plurality of indentations 116 radially spaced from the hole and circumferentially spaced from each other. The segment defines, from each inner wall of the slot 114, a centrally located knob 117 and a plurality of bosses 118 radially spaced spaced from the knob and circumferentially spaced from each other. A garment supporting surface 109A extends from the top of the segment.

In use, each segment 101A is snapped into an adjoining segment. In particular, the disc 113 of one segment is pressed into the slot 114 of another segment until the knobs 117 are received into the hole 115. As one segment 101A is turned relative to an adjoining segment, the bosses 118 are received into the indentations 116 to define selectable angular relationships between the segments. Thus, the segments can be bent relative to each other to define a distal end of lesser lateral extension as shown by broken lines 112. The surfaces 109A are dimensioned to abut when the segments are aligned with the associated proximal portion 104A as shown in FIG. 5B. The lateral extent of the distal end can also be reduced by simply removing one or more of the segments 101-A from their neighbor or by replacing one of the segments. It should be noted that the embodiment 101A is exemplary and various modifications are possible to obtain the similar angular selectable relationship between the segments.

Figure 2B:
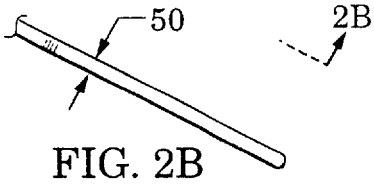
FIG. 2B is a view along the plane 2B—2B of FIG. 2A.

FIGS. 6A and 6B are elevation views of another preferred adjustable width hanger embodiment 120 which extends the concept of the invention to the traditional wire hanger use in laundry shops. The integral wire hanger 120 is similar to the hanger 40 of FIG. 2. However, the hanger 120 is constructed of wire rather than plastic. The hanger includes arms 122, 124 and a brace in the form of a horizontal support 125. One of the arms is wrapped about the other at a hanger medial region 126 and the other extends upward where it is formed to define a suspension hook 127. The arms 122, 124 are joined with the horizontal support 125 at junctions 128, 129. In particular, they are joined by wrapping each opposite end of the horizontal support 125 about a different one of the arms. The junctions 128, 129 form a boundary between the proximal portion 130 and the distal portion 132 of each arm. The joined proximal portions 130 and horizontal support 125 have sufficient load bearing strength to support common garments while the distal portions 132 are unsupported to facilitate bending thereof This bending is further facilitated by forming the distal portions of a ductile material with a sufficiently reduced cross sectional area.

In use, each distal end 132 is bent downward as shown in FIG. 6B to adjust the shoulder-shoulder support region 134 to a specific garment. FIGS. 6C, 6D and 6E are each views of the area within the curved line 6C of FIG. 6B which illustrate other methods of bending the distal ends 132 to accommodate specific garments. In FIGS. 6C and 6D, the distal end 132 has been bent respectively upward and downward to form hooks 136 and 138 which enhance support of garments such as skirts. In FIG. 6D, the distal end has been formed back on itself to present a smoothly shaped end 139 that reduces the chance of possible garment damage. The horizontal support 125 is also configured to support other garments, e.g., slacks, pants.

In FIG. 6A, the distal portions 132 of the hanger 120 terminate in simple ends 141. However, the distal portions 132 can be formed to enhance their support of garments by more closely conforming to the garment shape. Accordingly, FIGS. 6F, 6G and 6H illustrate some exemplary garment supporting shapes of the ends 141. In FIG. 6F, the distal portion is bent back and wrapped about itself at an interior end 142. In FIG. 6G, the distal portion is wrapped about itself at both an exterior end 143 and the interior end 142. FIGS. 6F and 6G also show that the distal end is first bent to define a loop 144 at the exterior end. In FIG. 6H, the distal portion is wrapped back and spaced from itself to define a loop 145. The distal portion is joined to itself at the interior end 142 with the aid of a metal sleeve 146.

Figure 7:
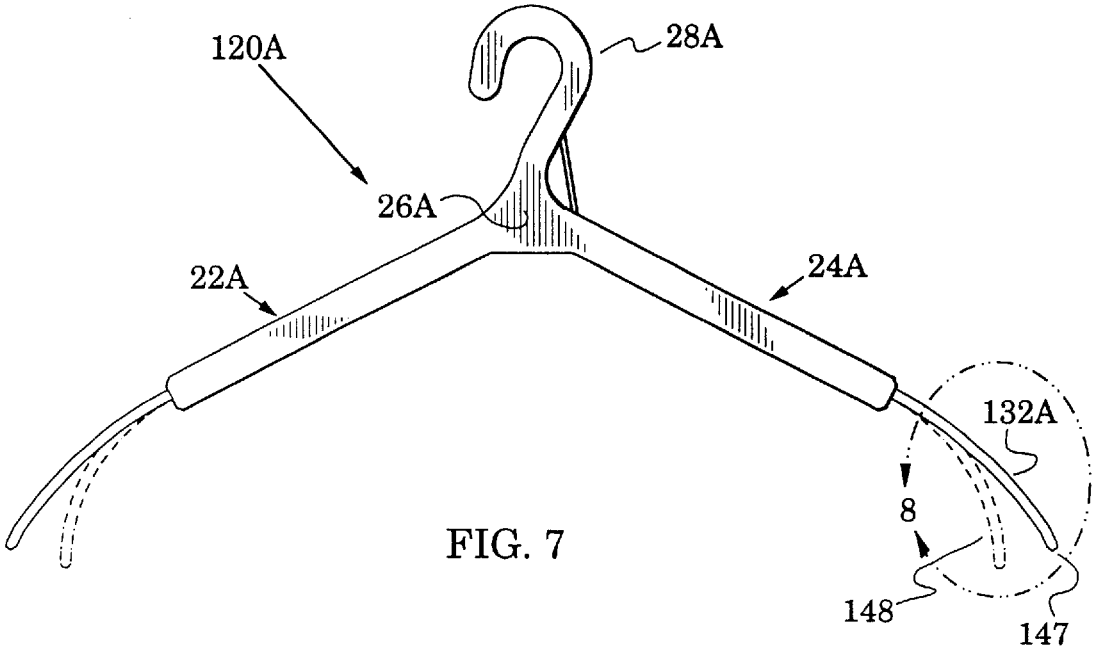
FIG. 7 is an elevation view of another preferred adjustable width garment hanger embodiment.

FIG. 7 illustrates another embodiment 120A which combines the teachings of hanger 120 of FIGS. 6 and hanger 20 of FIGS. 1. The embodiment 120A has proximal arm portions 22A, 24A, medial portion 26A and suspension member 28A formed similar to the hanger 20 and preferably of plastic. The distal arm portions 132A are formed of ductile wire 147 similar to the embodiment 120 and these portions 147 are each carried by their associated proximal portions, e.g., molded therein. The distal portions 147 can easily be bent as indicated by broken lines 148 to lessen their lateral extension.

Figure 8A:
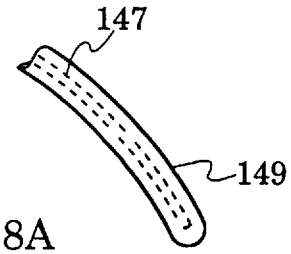
FIG. 8A is a view of structure within the curved line 8 of FIG. 7 illustrating a preferred distal end.
Figure 8B:
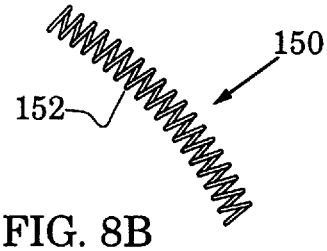
FIG. 8B is a view similar to FIG. 8A illustrating another preferred distal end.
Figure 8C:
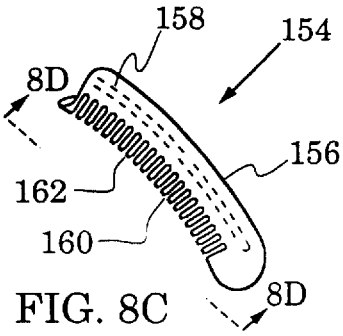
FIG. 8C is a view similar to FIG. 8A illustrating another preferred distal end.

FIG. 8A is a view of the structure within the curved line 8 of FIG. 7 illustrating that the ductile wire 147 can carry a plastic sleeve 149 to lessen the danger of injury to a user of the hanger or damaging the garment. FIG. 8B illustrates another distal end embodiment 150 coiled in the form of a resilient helix 152. The helix 152 can be of any ductile material, e.g., plastic coated wire. FIG. 8C shows another distal end embodiment 154 which includes a resilient sleeve 156 over a ductile wire 158. The sleeve 156 is shaped to form a plurality of slots 160 on its lower surface which, in turn, define segments 162 therebetween. The slots 162 facilitate bending the wire 158 as indicated in FIG. 7. The structure also serve to define a bending limit or stop when the wire 158 has been bent to the point where each segment 162 abuts its neighbor segment.

Figure 8D:
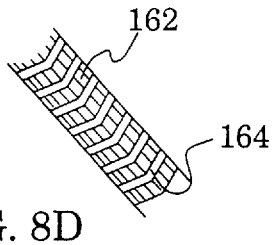
FIG. 8D is a view along the plane 8D—8D of FIG. 8C.

FIG. 8D is a view of the bottom of the distal end embodiment 154 illustrating an embodiment in which each segment has an nonplanar transverse face. In particular, each segment 162 defines a nonplanar face in the form of a V shaped transverse face 164 that nests into a similar V shape of its neighbor. Once the end 154 has been bent to where segments 162 abut, the faces 164 resist forces that might cause transverse twisting. Other nonplanar shapes that would facilitate the ability of the faces 164 to resist transverse forces include U shapes.

As described above, the distal ends 132 of the hanger embodiment 120 illustrated in FIGS. 6A, 6B are configured with ductile material to facilitate bending thereof However, this bending may be further facilitated by the use of a tool especially arranged for this purpose. Accordingly, the preferred tool embodiment 180 of FIG. 9 includes a bar-shaped mandrel 182 and a plurality of pegs 184 extending laterally from a mandrel side 186. The pegs 184 are spaced progressively further from the mandrel top 188. In use, a hanger 120 having the distal end shown in FIG. 6G is positioned with its loop 146 received over a selected one of the pegs 184. When the hanger frame is then rotated over the mandrel top 188 as indicated by the arrow 190, the distal end will be bent substantially as shown in FIG. 6B. Obviously, if the selected peg 184 is spaced further from the mandrel top 188, more of the distal end will be bent so that the shoulder-to-shoulder spacing 134 in FIG. 6B will be reduced.

Figure 10:
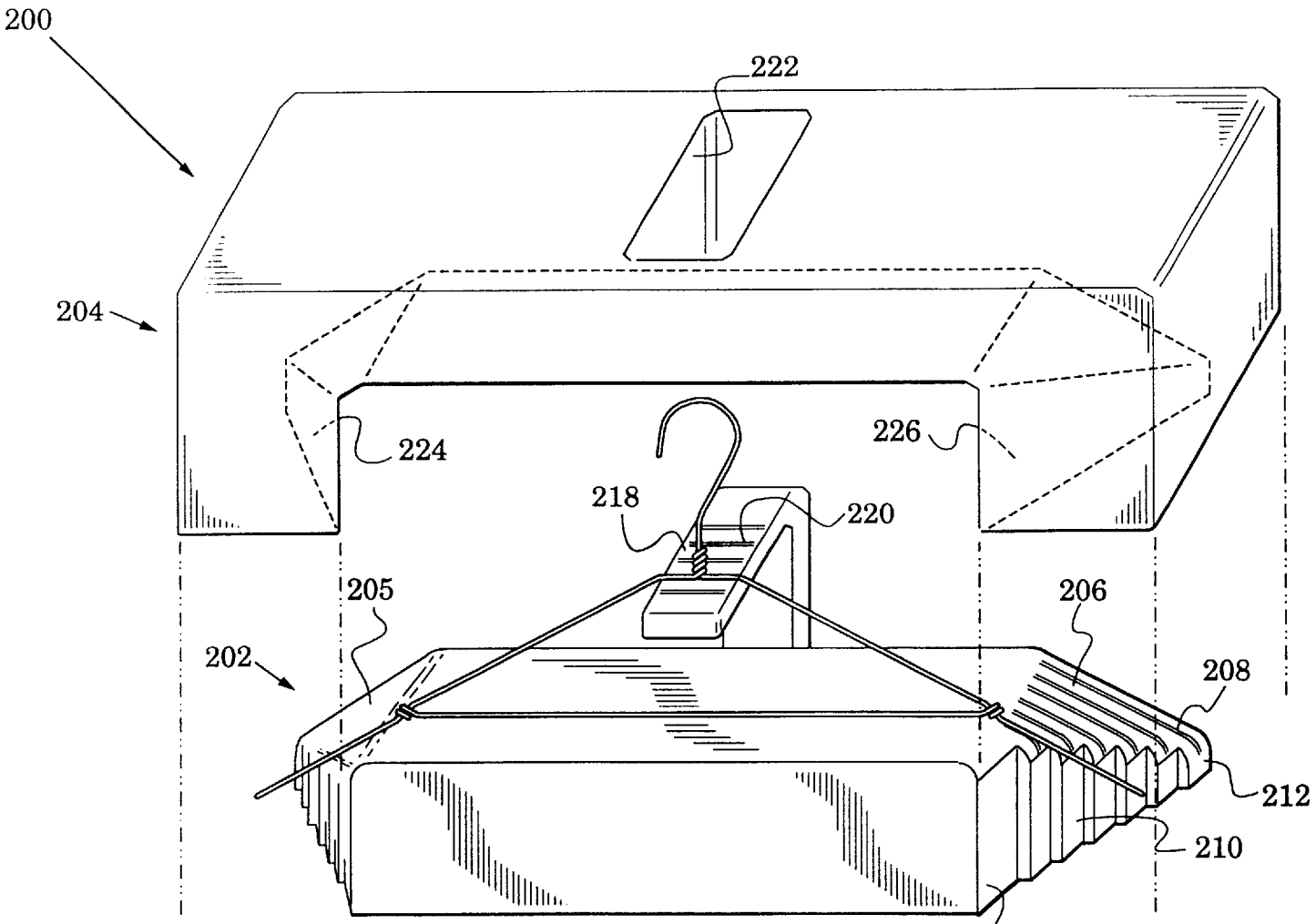
FIG. 10 is another preferred tool embodiment for bending the distal ends of the hangers of FIGS.6.

Another preferred tool embodiment 200 for bending distal hanger ends is illustrated in FIG. 10. The tool 200 includes a mandrel 202 and a swaging member 204. The mandrel 202 includes a pair of spaced and tilted planes 205, 206. Each of the planes define a plurality of spaced channels 208 for receiving the distal ends 132 of a garment hanger such as the hanger 120 of FIG. 6A. The spacing of the planes 205, 206 is dimensioned to be somewhat greater than the spacing between the junctions 128, 129 of the hanger.

Figure 9:
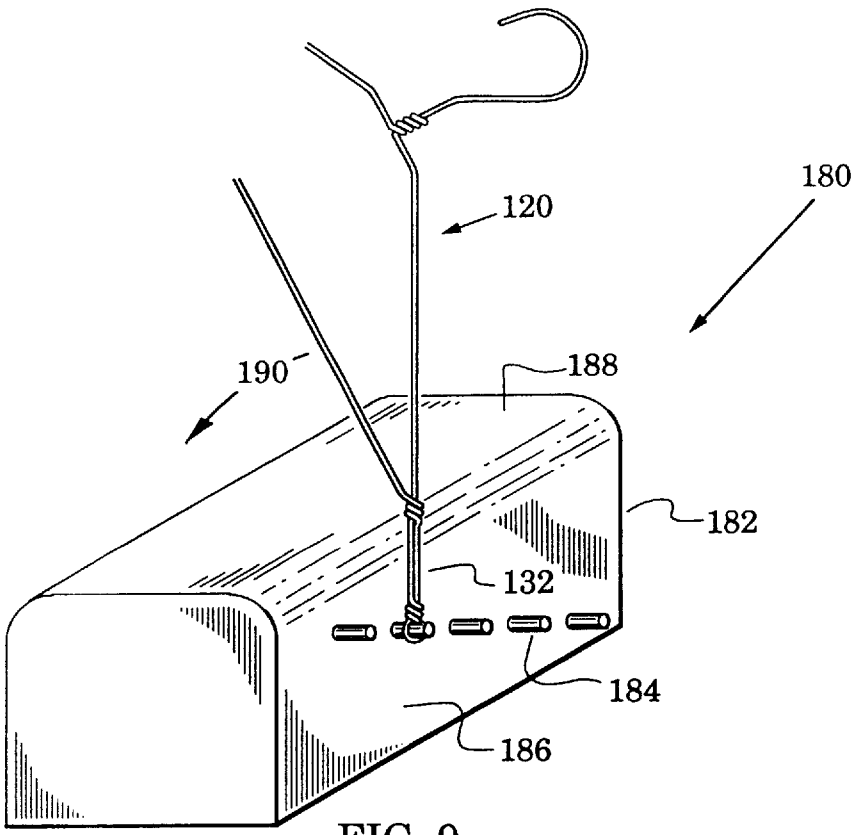
FIG. 9 is a preferred tool embodiment for bending the distal ends of the hangers of FIGS. 6.

The outer end terminates in a face 210 which tapers away from the medial portion of the mandrel so that the length of each succeeding channel 208 increases from the front end 211 of the face 210 to its rear end 212. Thus, more of the distal end 132 protrudes over the face 210 if the selected channel is adjacent the rear end 212 than if it is adjacent the front end 211. An arm 218 is located medially on the mandrel 202 and spaced above the planes 204,206. The arm 218 defines a plurality of spaced grooves 220 to receive the medial portion of the hanger 120. The waging member 204 defines a medial slot 222 to receive the hanger hook 127 and the mandrel arm 218. The lower surface of the swaging member 204 is recessed and configured to conform to the shape of the mandrel 202. In particular, interior faces 224, 226 are spaced and tapered front to back to closely neighbor the mandrel faces 211 when the swaging member 204 is forced downward over the mandrel 202. The above embodiments of hanger span adjustment tool are especially suitable to be used in laundry shops where wire hangers are mostly used. In summary, the method of using a tool to adjust various embodiments disclosed offers efficient hanger adjustment to the trade. The method comprises a step to set up a tool suitable to adjust a type of predefined adjustable hanger; a step to specify the hanger width desirable and a step to activate the tool and adjusting the hanger to the desirable width. In general, different kind of garment hanger structure may require different adjustment tool. For example, a driving motor is required to adjust the adjustable hanger of U.S. Pat. No. 5,102,019. When a specific adjustable hanger is defined, people skill in the trade should be able to design appropriate adjustment tool. The embodiments of FIG. 9 and 10 are exemplary and the designs of different adjustment tool should be embraced within the scope of the invention. It should also be noted that the definition of adjustment "tool" covers both the "fixture" of FIG. 9 where the stationary "tool" or "fixture" passively "activate" the distal portions of the wire hanger to adjust the hanger width. Alternately, FIG. 10 illustrates a tool which dynamically activates the adjustment of the hanger width.

In use, a hanger is placed over the mandrel 202 as shown in FIG. 10 with the distal ends 132 received into selected channels 208 and the medial hanger portion received into a corresponding groove 220. The swaging member 204 is pressed downward over the mandrel 202 to cause the distal ends 132 to bend down as shown in FIG. 6B. Selection of the channel 208 obviously dictates the resulting shoulder-to-shoulder spacing 134 of FIG. 6B.

Figure 11A:
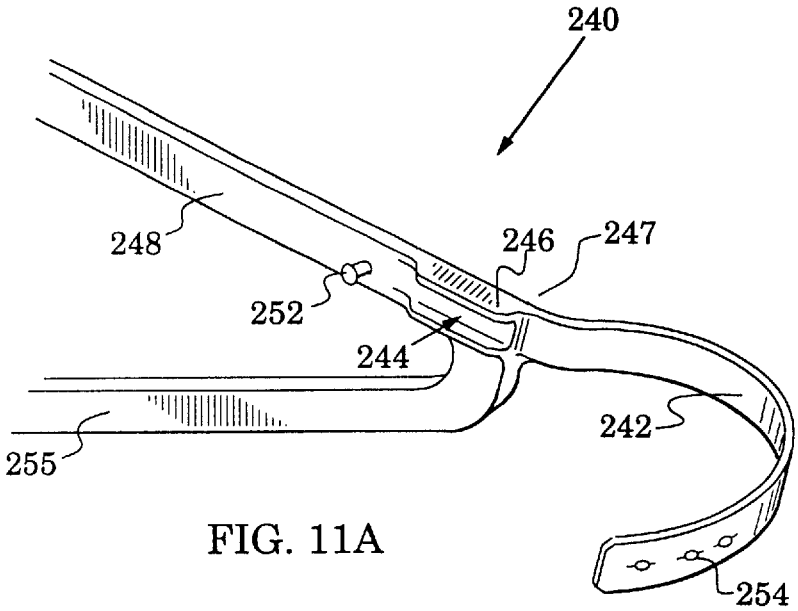
FIG. 11A is a perspective view of another preferred hanger embodiment in an unlocked position.
Figure 11B:
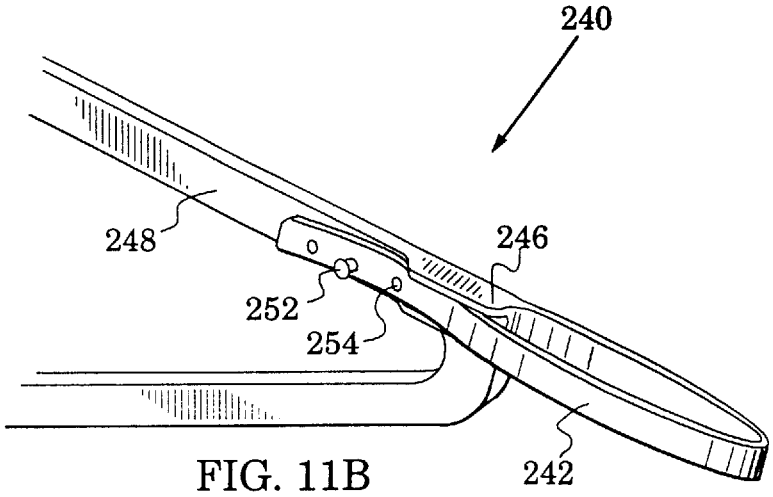
FIG. 11B is a perspective view of the hanger of FIG. 1 IA in a locked position.

FIGS. 11A, 11B illustrate two positions of another preferred garment hanger embodiment 240. The hanger 240 is similar to the hanger 20 of FIG. 1A but substitutes resilient plastic distal portions in the form of a strap 242 for the trimmable distal portions 34. A guide channel 244 consisting of vertically spaced walls 246 is located at the junction 247 between the proximal arm portion 248 and the distal portion 242. The guide channel 244 is aligned with the proximal arm 248. A button 252 extends laterally from the proximal portion and is aligned with the guide channel 244. A plurality of spaced holes 254 are defined in the distal portion 242. In use, the strap 242 is bent from the unlocked position of FIG. 11A to loop back on itself and then is inserted through the guide channel 244 with a selected hole 254 received over the button 252. The strap 242 loops substantially within a horizontal plane to obtain the locked position of FIG. 11B. A hole 254 is selected to adjust the shoulder-to-shoulder spacing 36 shown in FIG. 1A. The hanger 240 also includes a horizontal rod 255.

Figure 12A:
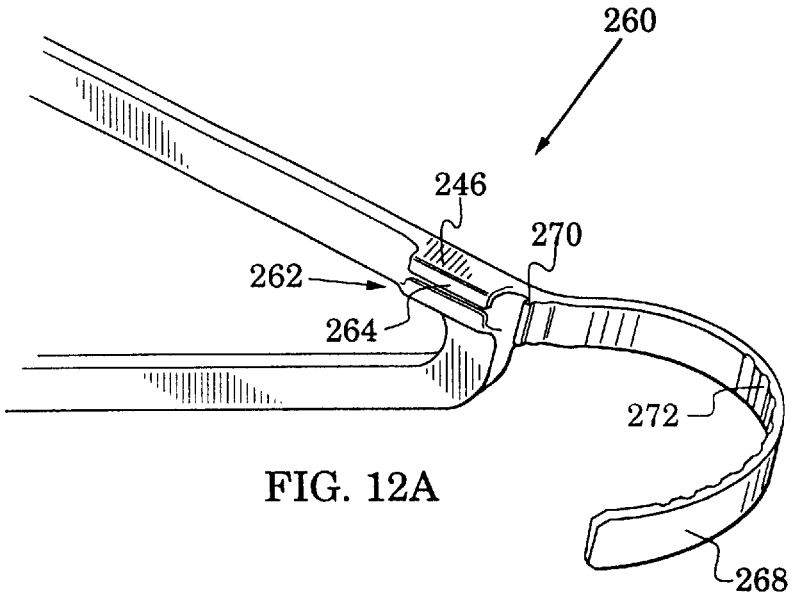
FIG. 12A is a perspective view of another preferred hanger embodiment in a unlocked position.
Figure 12B:
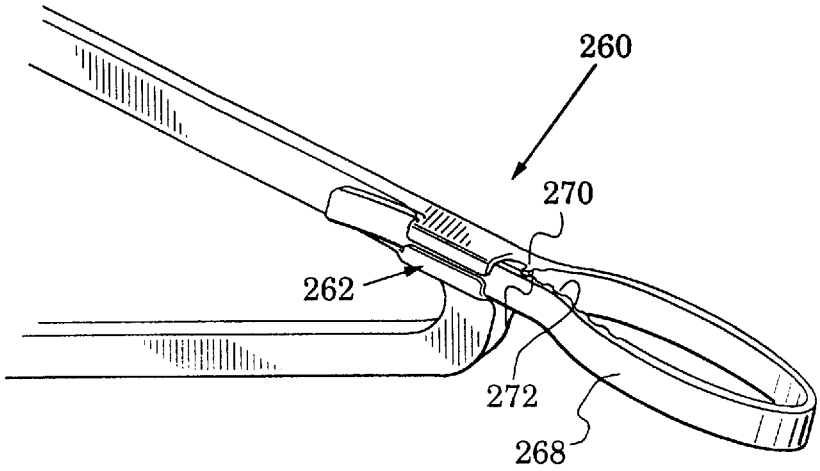
FIG. 12B is a perspective view of the hanger of FIG. 12A in a locked position.

Another preferred garment hanger embodiment 260, similar to the hanger 240, is shown in FIGS. 12A, 12B. The hanger 260 includes a guide channel 262 which has a vertically arranged lip 264 on each of the walls 246 of the hanger 240. Thus, the walls 246 and lips 264 form a guide channel 262 that provides more transverse support to a strap 268. Spaced outboard from the guide channel 262 is a tab 270 and the strap 268 defines a plurality of spaced grooves 272. In use, the strap 268 is looped back on itself and received through the guide channel 262 with a selected one of the grooves 272 received over the tab 270 as shown in FIG. 12B. The grooves 272 and tab 270 provide a detent feel to the adjustment.

Figure 13A:
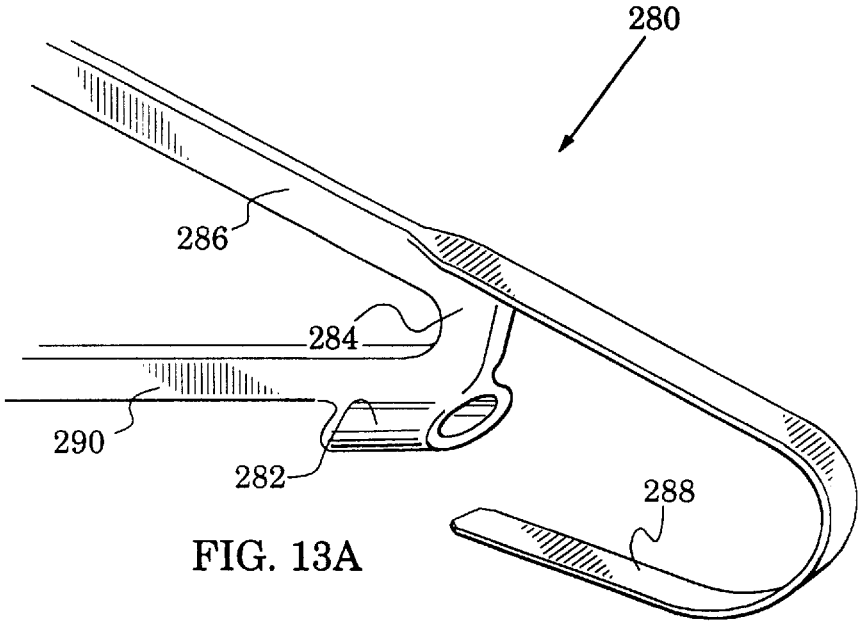
FIG. 13A is a perspective view of another preferred hanger embodiment in an unlocked position.
Figure 13B:
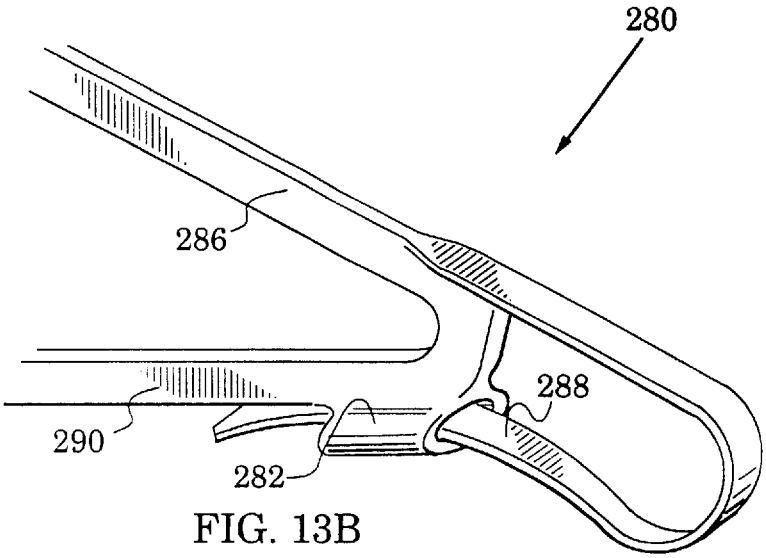
FIG. 13B is a perspective view of the hanger of FIG. 13A in a locked position.

Another preferred garment hanger embodiment 280 is illustrated in FIGS. 13A, 13B. The hanger 280 is similar to the hanger 240 but replaces the guide channel 244 with a guide tube 282 that is defined by the hanger at the junction 284 between the proximal arm portion 286 and the resilient distal portion 288. Whereas the guide channel 244 was aligned with the proximal arm, the guide tube 282 is aligned with a horizontal rod 290. In use, the resilient distal portion 288 is looped back on itself and inserted through the guide tube 282 as shown in FIG. 13B. The distal portion 288 loops substantially within a vertical plane to obtain the locked position of FIG. 113B and provide. The lateral looping of FIG. 12A provides a larger footprint for the shoulder support of garment as well as a rigid downward support to the distal portion while the downward looping of FIG. 13A provides an elastic downward to the distal portion. Similar concept is applicable to other embodiments of the embodiments of the invention such as FIG. 5B and 6A.

Figure 14:
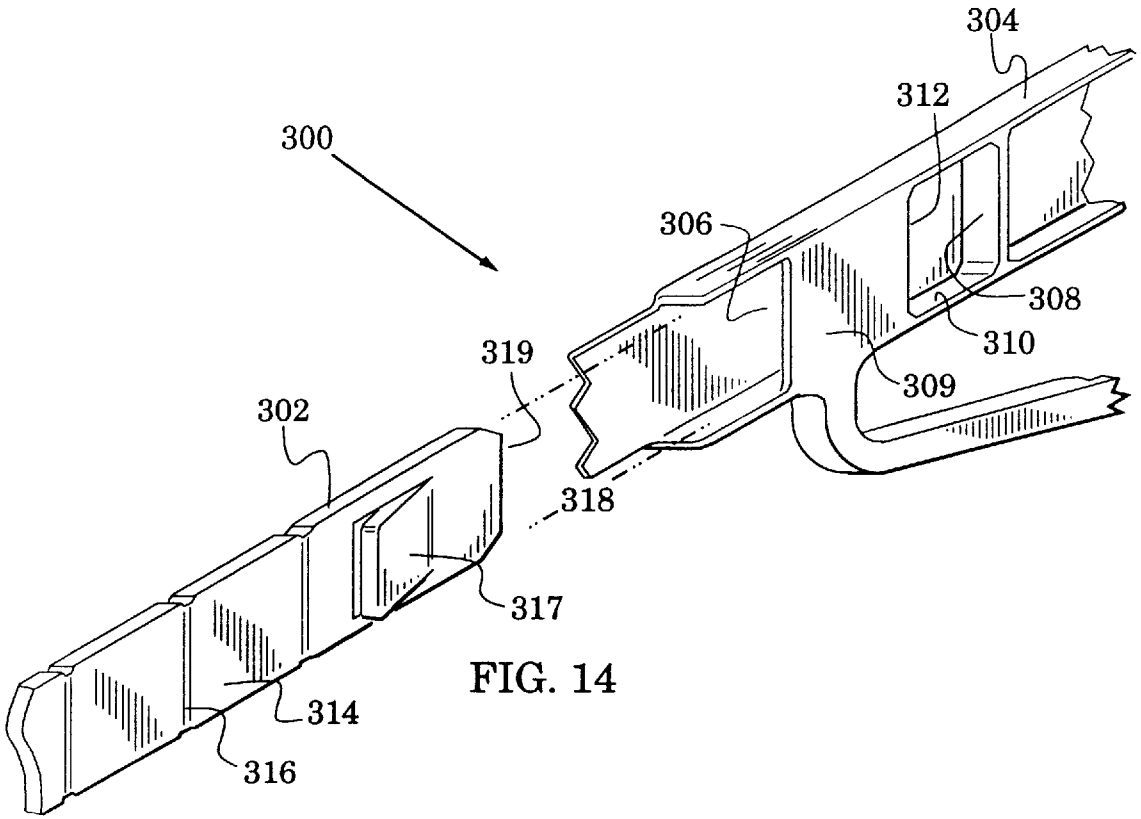
FIG. 14 is a perspective view of another preferred garment hanger embodiment.

FIG. 14 is a perspective view of another adjustable width garment hanger embodiment 300 illustrating a distal portion to be a separated member removably carried by its respective proximal portion. The hanger 300 is similar to the hanger 60 of FIG. 3A but a replaceable distal portion 302 is substituted for the fixed distal portion 61. FIG. 14 shows that the proximal arm portion 304 defines a guide channel 306. The guide channel 306 terminates towards the hanger medial region in a transversely oriented rib 308. A lateral wall 309 of the guide channel 306 defines an aperture 310 having an edge spaced outwardly from the rib 308 to form a stop 312.

One end of the distal portion defines a resilient flap 317 whose free end is directed away from a distal portion end 319. The distal portion 302 is inserted, as indicated by the broken lines 318, into the guide channel 306. The flap 317 is compressed laterally by the channel wall 309 until the flap 317 is within the aperture 310 where its restoring force urges it outward to engage the stop 312. The distal portion 302 is now securely retained in the channel 306 with movement towards and away from the hanger medial region prevented by abuttment between the rib 308 and the distal portion end 319 and abuttment between the stop 312 and the flap 317.

A set of distal portions 319 can be formed wherein the set includes distal portions having various lengths. In use, a distal portion 302 is selected from the set, its end 319 inserted in the channel 306, and the distal portion slid laterally inward until the resilient flap 317 clears the stop 312. This is repeated with the opposite distal portion. The distal portions can thus be selected from the set and inserted in their respective channels to achieve various selectable garment supporting widths (see 36 in FIG. 1).

In another preferred embodiment, the distal portion 302, similar to the distal portion 61 of FIG. 3A, has a plurality of removable tabs 314 delineated by grooves 316. In use, the tabs 314 can be selectively removed as described above relative to the hanger 60. In addition, the distal portion can be "refilled" or replaced by another so that a different selection of removed tabs can be made. As described above, this is effected by pressing the flap 317 on each distal portion laterally until it clears the stop 312. That distal portion is then removed and replaced by a new distal end. The distal portion 302 can be of different shape, dimension, made with materials of different properties as disclosed in other embodiments. Alternately, the distal portion can be simply a collection of supporting arms of different lengths. The connecting mechanism of 302 and 304 are exemplary and various modifications are possible to achieve the same result.

Figure 15:
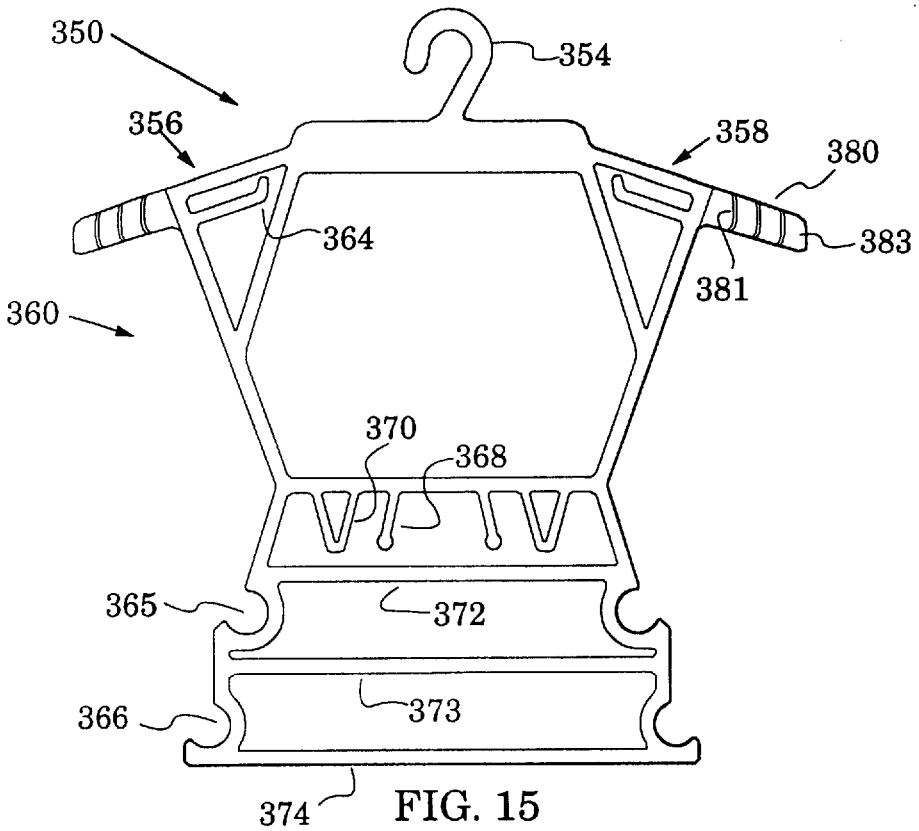
FIG. 15 is an elevation view of a typical children's garment hanger modified in accordance with the present invention.
Figure 16:
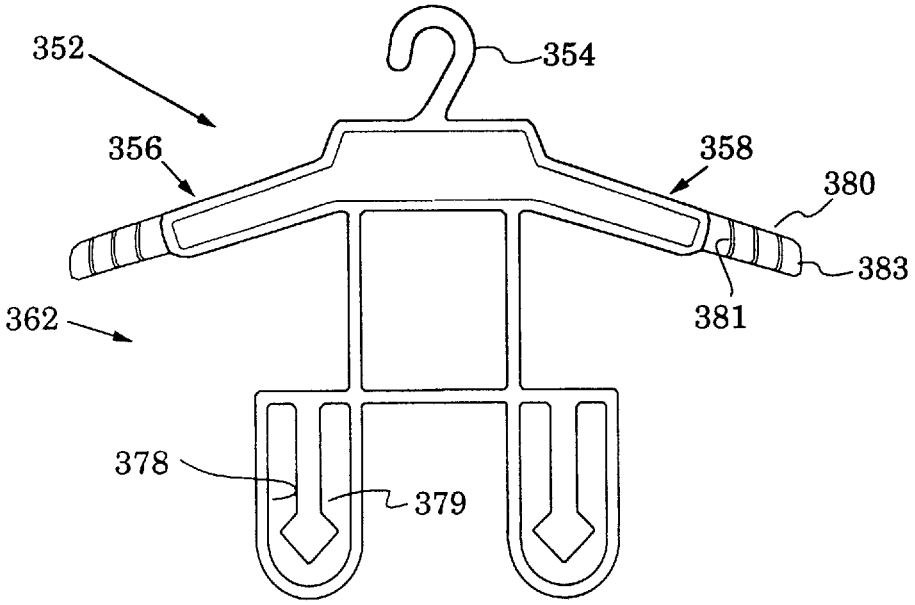
FIG. 16 is an elevation view of another typical children's garment hanger modified in accordance with the present invention.

In addition to hangers having simple transverse braces disposed beneath their laterally extending arms, e.g., brace 111 in FIG. 5A, it is recognized that the teachings of the invention may be extended to hangers that typically include more complex garment supporting structures. For example, FIGS. 15 and 16 illustrate garment hangers 350, 352 directed to support of children's clothing. Each of these hangers have a hanger suspension member 354 and laterally extending arms 356, 358 and they are each scaled appropriately to be compatible with the reduced size of children's clothing.

Additionally, they also respectively have garment suspension systems 360, 362 disposed beneath their laterally extending arms. The suspension system 360 includes hooks 364 365, 366, tabs 368, loops 370 and bars 372, 373 and 374. The suspension system 362 includes loops 378 and tabs 379. These suspension systems 360, 362 are configured for receiving and holding slacks, skirts, shorts and other typical children's clothing. All these variations are collectively defined as a polygonal frame to be extended downward from the shoulder supporting arms.

These hangers are preferably molded of plastic and, in accordance with the invention, define distal portions 380 which each have grooves 381 to define a plurality of tabs 383. Similar to the hanger 60 of FIG. 3A, these tabs can be selectively removed to conform the hangers 350, 352 to garments of specific sizes.

In reviewing the common properties of the various embodiments described, it can be observed that the minimal width of the expandable hanger is proximately defined by the span between the remote ends of the proximal portions which are usually within the range 280 mm to 380 mm. The maximum span of the hanger is defined by the maximum span of the distal portions. Typically, each distal portion is desirably designed to handle no more than 120 mm of extension adjustment.

Another advantageous and common characteristic of all the various embodiments is that that the invention allows the transition of each proximal portion along its axis towards the respective distal portion to be relatively smoothly. In the structure of the embodiments where the distal portions are to be bent (FIG. 6B, 11B, 12B and 13B), the loop back is desirable to be towards the lateral sides (FIG. 11A, 11B, 12A, 12B) or in the downward direction (FIG. 13A, 13B) in order to maintain the smooth continuous profile of the hanger arms top surfaces. Upward bending direction will affect the smooth continuous profile and is less desirable. Sometimes, a designer may intentionally sacrifice a little bit of the continuity of the hanger arms top surface for aesthetic reasons such as adding some decoraction on the top surface of the the support arms. Alternately, non-slipping material may also be added on top of the hanger arms. All these conditions and various minor variations should be included in the coverage of the invention.

In addition, many embodiments of the invention such as FIG. 6A, FIG. 7, FIG. 13A and FIG. 13B are also capable of offering a continuous adjustment of the hanger width to exactly match with the shoulder width of a garment. This is also an advantage when compared with many regular expandable garment hanger design offering limited specific width increments for the hanger span adjustment.

It can be further observed that the distortion process of the distal portion results in a change in the physical shape of the distal portion. This distortion process includes the removal of material of the distal portion, distorting the shape of the distal portions and angular adjustment of components to change the shape of the distal portions. Distortion can be made at more than one point along the axis of the distal arm so as to provide different width adjustment of the hanger. After the distortion process to provide the desirable shoulder supporting span, the distal portion is maintained in shape and ready to support the garment.

From the foregoing it should now be recognized that adjustable garment hanger embodiments have been disclosed herein especially suited for lateral width adjustment to correspond to the shoulder-to-shoulder span of a supported garment. The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. An adjustable width garment hanger, comprising:

a suspension member;

first and second elongate arms extending in opposite lateral directions from said suspension member thereby defining a garment supporting width;

each of said first and second arms including a proximal portion having a proximal end located proximate to said suspension member and a remote end located remote from said suspension member, said proximal portions are supported relative to one another at an obtuse angle therebetween; and each of said first and second arms further including a distal portion having a proximal end located proximate to the corresponding remote end of said proximal portion and extends proximately along the axis of its respective proximal portion towards a distal end remote from said proximal portion; wherein each of said distal portions is configured to be readily physically distorted at multiple points along its axis for varying its lateral extension from its respective proximal portion to adjust said garment supporting width;

the span between the remote ends of said proximal portions defines proximately the minimum shoulder width of garment to be supported and the maximum span between the remote ends of said distal portions defines proximately the maximum shoulder width of garment to be supported; and each said proximal portion is stronger relative than the corresponding distal portion of the garment hanger.

2. The adjustable garment hanger of claim 1 further including a brace carried between said proximal portions for strengthening thereof.

3. The adjustable garment hanger of claim 1 wherein each of said distal portions is a separated member carried by its respective proximal portion.

4. The adjustable garment hanger of claim 3 wherein each of said distal portions is removably carried by its respective proximal portion.

5. The adjustable garment hanger of claim 3 wherein each of said distal portions comprises of a material different from the respective proximal portion.

6. The adjustable garment hanger of claim 3 wherein each of said distal portions is selectable from a set of distal portions of different dimensions.

7. The garment hanger of claim 1 wherein said distal portions are configured to be continuously adjustable within an adjustment range specified to provide an exact shoulder supporting width.

8. The garment hanger of claim 1 wherein each of said distal portions is configured to be distorted and maintained in the distorted shape to secure said garment supporting width before a garment is put on.

9. The adjustable garment hanger of claim 1 wherein each of said distal portions is comprised of a resilient material.

10. The adjustable garment hanger of claim 1 wherein the junction between each distal portion and its respective proximal portions is configured to provide an approximately homogeneous upper supporting surface suitable for supporting the shoulder portion of a garment.

11. The adjustable garment hanger of claim 1 wherein each of said arms has a cross sectional area that reduces as the arm transitions from its proximal portion to its distal portion to facilitate trimming of said distal portion to reduce its lateral extension.

12. The adjustable garment hanger of claim 11 wherein each of said distal portions have a transverse dimension of not more than 3 millimeters.

13. The adjustable garment hanger of claim 1 wherein each of said distal portions includes a plurality of selectively removable tabs, said tabs defined by laterally spaced indentations to facilitate their removal.

14. The adjustable garment hanger of claim 13 wherein each of said tabs includes an indicia indicative of its contribution to the lateral extent of its respective distal arm.

15. The adjustable garment hanger of claim 13 wherein each of said tabs includes a portion disposed to abut a garment carried by said first and second arms and wherein said portion extends laterally beyond any indentation associated with that tab to protect said garment therefrom.

16. The adjustable garment hanger of claim 1 wherein each of said distal portions includes a plurality of laterally spaced segments, a first one of said segments rotatably carried by the respective proximal portion and the remainder of said segments rotatably attached to an adjoining segment to facilitate bending of said distal portion to reduce its lateral extension.

17. The adjustable garment hanger of claim 16 wherein each of said segments defines a set of rotation means, the rotation means of one of said segments rotatably received by the mating rotation means of the adjoining segments; each pair of adjoining segments further defines adjustable detent means to provide a plurality of angular selections in between the two adjoining segments.

18. The adjustable garment hanger of claim 1 wherein each of said proximal portions and distal portions comprises a wire, said wire of each distal portion configured of a ductile material with a cross sectional area sufficiently small to facilitate bending of said wire by a hanger user to reduce its lateral extension.

19. The adjustable garment hanger of claim 1 wherein each of said proximal portions is comprised of plastic and each of said distal portions comprises a wire, said wire of each distal portion configured of a ductile material with a cross sectional area sufficiently small to facilitate bending of said wire by a hanger user to reduce its lateral extension.

20. The adjustable garment hanger of claim 1 wherein each of said distal portions comprises a wire, said wire further includes a resilient coating.

21. The adjustable garment hanger of claim 20 wherein said coating defines a plurality of laterally spaced slots, said slots thereby defining segments therebetween, said slots facilitating bending of said proximal portions until stopped by abutment of neighboring segments.

22. The adjustable garment hanger of claim 9 wherein each of said distal portions is configured to define a helix.

23. The adjustable garment hanger of claim 1 wherein each of said distal portions comprises a resilient strap and each of said proximal portions is configured to releasably retain said strap when it is bent back upon itself to reduce its lateral extension.

24. The adjustable garment hanger of claim 23 wherein each of said proximal portions and its respective distal portion are configured to be mutually and releasably engageable in a plurality of selectable lateral relationships therebetween.

25. The adjustable garment hanger of claim 23 wherein each of said proximal portions defines a guide structure to receive said strap when it is bent back to reduce its lateral extension.

26. The adjustable garment hanger of claim 24 further including: a plurality of holes defined by each of said straps; and a button defined by each of said proximal portions to receive a selected one of the holes of its associated strap to fix its lateral extension.

27. The adjustable garment hanger of claim 24 further including: a plurality of grooves defined by each of said straps; and a tab defined by each of said proximal portions to receive a selected one of the grooves of its associated strap to fix its lateral extension.

28. The adjustable garment hanger of claim 1 wherein each of said distal portions comprises a resilient strap bent back laterally to provide rigid downward support to the garment.

29. The adjustable garment hanger of claim 1 wherein each of said distal portions comprises a resilient strap and bent back in a downward direction to provide elastic downward support to the garment.

30. The adjustable garment hanger of claim 1 further comprise a polygonal frame extending downward from said proximal portions.

31. The adjustable width garment hanger of claim 1 wherein any characteristic of the shape of said distal portion, including the extension direction and dimension is distorted to adjust said garment supporting width.

32. The adjustable garment hanger of claim 3 wherein each of said distal portion is selectable from a set of distal portions of different properties.

33. The adjustable garment hanger of claim 1 wherein said distal portion is configured of a ductile material.

34. The adjustable hanger of claim 33 wherein said hanger is a wire hanger.

* * * * *